US008464481B2

(12) United States Patent
Wauhop

(10) Patent No.: US 8,464,481 B2
(45) Date of Patent: Jun. 18, 2013

(54) SEGMENTAL RETAINING WALL CORNER BLOCK

(75) Inventor: Billy J. Wauhop, Belvidere, NJ (US)

(73) Assignee: E. Dillon & Company, Swords Creek, VA (US)

( * ) Notice: Subject to any disclaimer, the term of this patent is extended or adjusted under 35 U.S.C. 154(b) by 368 days.

(21) Appl. No.: 12/799,234

(22) Filed: Apr. 21, 2010

(65) Prior Publication Data

US 2010/0263310 A1 Oct. 21, 2010

Related U.S. Application Data

(60) Provisional application No. 61/214,252, filed on Apr. 21, 2009.

(51) Int. Cl.
*E04C 1/00* (2006.01)

(52) U.S. Cl.
USPC ..... 52/275; 52/284; 52/592.1; 52/592.3; 52/598; 52/604; 52/606

(58) Field of Classification Search
USPC ..... 52/275, 284, 286, 592.1, 592.3, 592.5, 52/598, 604, 606; D25/113, 114, 118
See application file for complete search history.

(56) References Cited

U.S. PATENT DOCUMENTS 1,534,353 A * 4/1925 Besser ..... 52/315
4,107,894 A * 8/1978 Mullins ..... 52/606
4,186,540 A * 2/1980 Mullins ..... 52/606
4,475,326 A * 10/1984 Hanson ..... 52/286
5,457,926 A * 10/1995 Jensen ..... 52/604
5,575,128 A * 11/1996 Haener ..... 52/286
7,882,674 B2 * 2/2011 Craven et al. ..... 52/606
7,963,727 B1 * 6/2011 Wauhop ..... 52/604

* cited by examiner

*Primary Examiner* — Mark Wendell
*Assistant Examiner* — Matthew J Smith
(74) *Attorney, Agent, or Firm* — Adams & Wilks

(57) ABSTRACT

A corner block has spaced-apart front and rear sections interconnected by two spaced-apart side sections that jointly define a through-cavity that extends through the block from a top face thereof to a bottom face. Upper protrusions are provided on the top face of the block, and lower protrusions are provided inside the cavity at the bottom of the block. The upper and lower protrusions are configured and arranged relative to one another so that when two corner blocks are stacked one atop another with one block rotated 90 degrees relative to the other, the upper protrusions of the lower block interlock with the lower protrusions of the upper block to interlock the two blocks. The corner blocks are constructed in two variants, a corner block A and a corner block B, which are mirror images or opposite hands of each other. The corner blocks A and B are alternately stacked upon one another to construct a 90-degree corner of a segmental retaining wall or other wall structure. Each corner block has two exterior sides, and the two exterior sides of each successive corner block are set back or offset from the two exterior sides of the preceding block by a predetermined setback.

23 Claims, 11 Drawing Sheets

SEGMENTAL RETAINING WALL CORNER BLOCK

RELATED APPLICATION

This application claims the benefit of U.S. Provisional Application No. 61/214,252 filed Apr. 21, 2009.

BACKGROUND OF THE INVENTION

1. Field of the Invention

The present disclosure relates generally to the field of segmental retaining walls and, more specifically, to corner blocks for use in forming a corner of a segmental retaining wall and techniques for manufacturing segmental retaining wall corner blocks.

2. Background Information

Retaining walls are widely used in a variety of landscaping and construction applications. Typically, they are used to maximize or create level areas and also to reduce erosion and slumping. They may also be used in a purely decorative manner. In the past, retaining wall construction was labor intensive and often required the skills of trained tradespeople such as masons and carpenters. More recently, retaining wall construction has become significantly simplified with the introduction of self-aligning, modular, molded blocks of concrete that may be stacked in courses without the use of mortar or extensive training. With these types of retaining wall blocks, it is possible to erect a segmental retaining wall quickly and economically, and the finished product creates the impression and appearance of a conventional block-and-mortar retaining wall.

One feature that allows the foregoing blocks to be so easily and precisely assembled is the interconnection between adjacent courses of blocks. Typically, each retaining wall block has one or more projections and one or more recesses located at oppositely facing surfaces, such as a top surface and a bottom surface, for example. The projections and recesses are complementarily shaped, with the projection protruding beyond the top (or bottom) surface of the block with the recess extending inwardly from the bottom (or top) surface of the block. In use, the projections of a first block are received within the recesses of a second block to interconnect and position the blocks one atop the other in a predetermined relation. When assembling a retaining wall, such interconnections make it possible to lay successive courses of blocks in an accurate and expedient manner. Moreover, such an assembled retaining wall is able to resist lateral forces exerted by the material being retained and reduce bowing. Blocks having these interconnections are usually the same size and may be assembled in a coplanar arrangement in only a simple, running bond pattern. Application Ser. No. 11/900,434, which is incorporated by reference herein in its entirety, discloses retaining wall blocks in which the projections and recesses are arranged so that adjacent courses are set back or offset a predetermined amount. With this type of retaining wall block, each successive course is offset from the preceding course by the same amount (setback) so that the assembled wall is skewed or sloped at a predetermined angle from the vertical.

When installing a segmental retaining wall, it is often necessary to construct a 90-degree corner which requires use of corner blocks. In the case of segmental retaining walls in which each successive course is set back a predetermined setback from the preceding course, each successive corner block must also be set back from the preceding corner block. Moreover, the setback of the stacked corner blocks must be the same as that of the retaining wall and furthermore, the setback must be formed on two sides of the corner to match the setback of the two runs of the retaining wall that extend from the corner.

The segmental retaining wall industry has several methods of providing for an interlocking stacked corner using corner blocks, both with and without external connectors. These include:

(1) A raised front lip which engages the bottom front and side of an upper corner block. This block must be made with an external "core puller" which adds time to the manufacturing cycle and therefore is costly to produce.

(2) A lower rear lip which engages the top rear surface of a lower corner block. This block utilizes one of its "full stretcher" blocks that has been manually hand-split to provide the corner piece. This method therefore is costly to produce.

(3) A lower core that engages the inside front and side wall of a lower corner block inside the block cavity. This block is manufactured as a solid unit and therefore is costly to produce.

(4) Other corner blocks are installed utilizing pins or connectors and therefore are costly to produce.

SUMMARY OF THE INVENTION

An object of the present invention is to provide a corner block that may easily be assembled, without the use of mortar, to construct a corner of a segmental retaining wall.

Another object of the present invention is to provide a corner block for a segmental retaining wall or other wall structure that can be easily and rapidly stacked atop another corner block and interlocked therewith without use of external connectors.

A further object of the present invention is to provide a corner block for constructing a corner of a segmental retaining wall or other wall structure, in which one corner block can be stacked atop another corner block with the two exterior sides of the upper corner block set back from the two exterior sides of the lower corner block.

Another object of the present invention is to provide a corner structure formed of stacked corner blocks that are interlocked with one another with each successive corner block having at two exterior sides offset from the two exterior sides of the preceding corner block.

A further object of the present invention is to provide two corner blocks that are the mirror image or opposite hand of each other and that can be alternatingly stacked one atop another to construct a corner of a segmental retaining wall or other wall structure.

A further object of the present invention is to provide a method of manufacturing a plurality of corner blocks in one manufacturing cycle.

The foregoing and other objects of the present invention are achieved by a corner block having spaced-apart front and rear sections interconnected by two laterally spaced-apart side sections that jointly define a through-cavity that extends through the block from a top face thereof to a bottom face. Upper protrusions are provided on the top face of the block, and lower protrusions are provided inside the cavity at the bottom of the block. The upper and lower protrusions are configured and arranged relative to one another so that when two blocks are stacked one atop another with one block rotated 90 degrees relative to the other, the upper protrusions of the lower block interlock with the lower protrusions of the upper block to interlock the two blocks.

The lower protrusions extend lengthwise along opposed walls of the cavity at the bottom of the block, each opposed wall having two protrusions which are spaced apart to form a gap between the two protrusions. The upper protrusions include two protrusions provided on the top face of the rear section of the block, the two protrusions being spaced apart from one another a distance equal to the gap between the lower protrusions so that when an upper block is placed on a lower block, the two upper protrusions on the lower block fit within the gaps formed by the lower protrusions on the upper block so that the upper and lower protrusions engage with one another to interlock the two blocks. At the same time, the opposed walls of the cavity straddle and engage with the two upper protrusions to interlock the two blocks.

The corner blocks are constructed in two variants, a corner block A and a corner block B, which are mirror images or opposite hands of each other. The corner blocks A and B are alternately stacked upon one another to construct a 90-degree corner of a segmental retaining wall or other wall structure. Each corner block has two exposed or exterior sides, and the two exterior sides of each successive corner block are set back or offset from the two exterior sides of the preceding block by a predetermined setback.

A third upper protrusion is provided on the top face of the corner block and extends from one side section lengthwise along the front section. The third protrusion is dimensioned and positioned to engage with an outer surface of an upper block to thereby assist in interlocking the upper and lower blocks.

The corner blocks A and B are manufactured in a four-block unit. The four-block unit consists of two diagonal corner blocks A and two opposing diagonal corner blocks B that are produced in one manufacturing cycle and subsequently split to form four individual corner blocks.

Additional objects, advantages and features of the disclosure will be set forth in part in the description which follows, and in part will become apparent to those skilled in the art upon examination of the following or may be learned by practice of the disclosure. The objects and advantages of the disclosure may be realized and attained by means of the instrumentalities and combinations particularly pointed out in the appended claims.

DETAILED DESCRIPTION OF THE INVENTION

Figure 1:
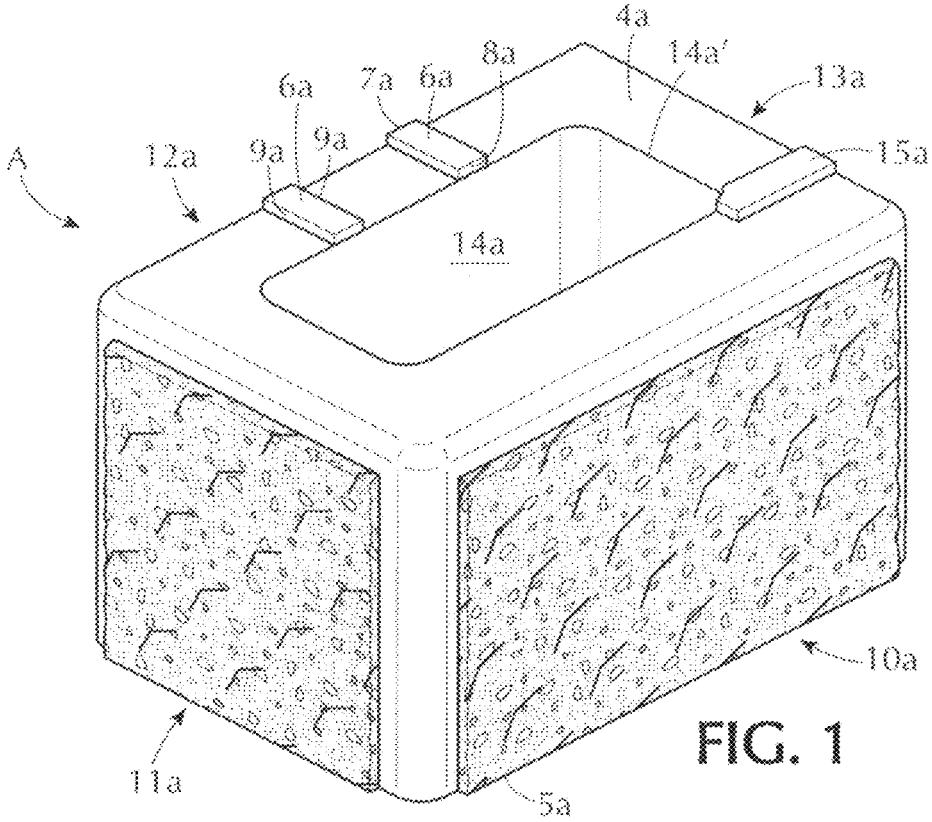
FIG. 1 is a top, front and left perspective view of a corner block A of one embodiment of the disclosure.

The figures in the drawings are simplified for illustrative purposes and are not necessarily depicted to scale. To facilitate understanding, identical reference numerals have been used, where possible, to designate identical elements that are common to the figures.

The appended drawings illustrate exemplary embodiments of the disclosure and, as such, should not be considered as limiting the scope of the disclosure that may admit to other effective embodiments. It is contemplated that features or steps of one embodiment may be beneficially incorporated in other embodiments without further recitation.

The term "exemplary" is used herein to mean "serving as an example, instance, or illustration". Any embodiment or design described herein as "exemplary" or "alternative" is not necessarily to be construed as preferred or advantageous over other embodiments or designs.

The corner block of the present invention has two variations, which are mirror images or opposite hands of each other. In the following description, these two variations are referred to as corner blocks A and B. The reference numerals used to describe corner block A have the suffix "a", and the same reference numerals with the suffix "b" are used to describe corner block B. Reference numerals without the suffixes "a" or "b" refer to corresponding elements or parts of both corner blocks A and B.

Referring to the drawings, FIGS. 1-6 illustrate a corner block A in accordance with one exemplary embodiment of the present invention. The corner block A is a molded concrete structure, as described more fully hereinafter, having a front section 10*a*, two side sections 11*a*,13*a* and a rear section 12*a*. The front section 10*a* and the rear section 12*a* are spaced apart from one another in the front-rear direction and interconnected by the two side sections 11*a*,13*a*. The side-to-side width of the front and rear sections 10*a*,12*a* is greater than that of the side sections 11*a*,13*a* so that the corner block A has a generally rectangular cuboid shape.

Figure 3:
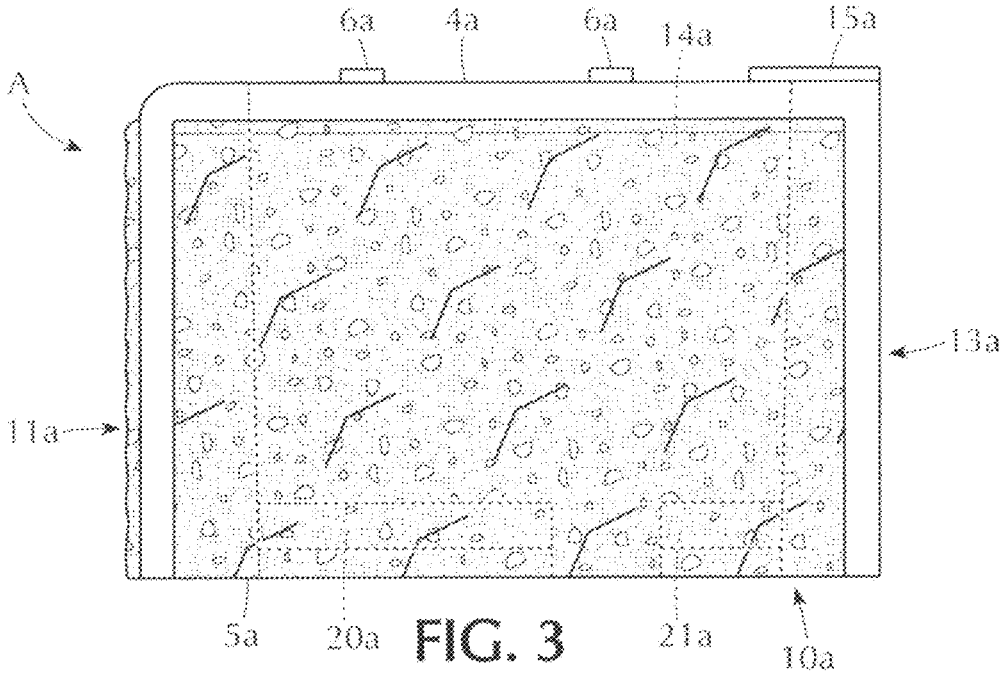
FIG. 3 is a front view of the corner block A.
Figure 4:
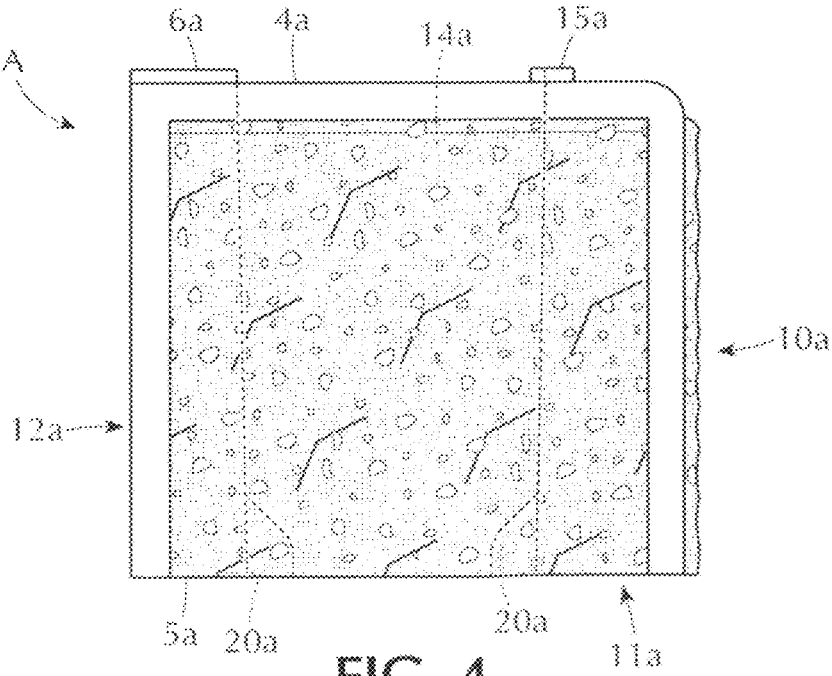
FIG. 4 is a left side view of the corner block A.
Figure 5:
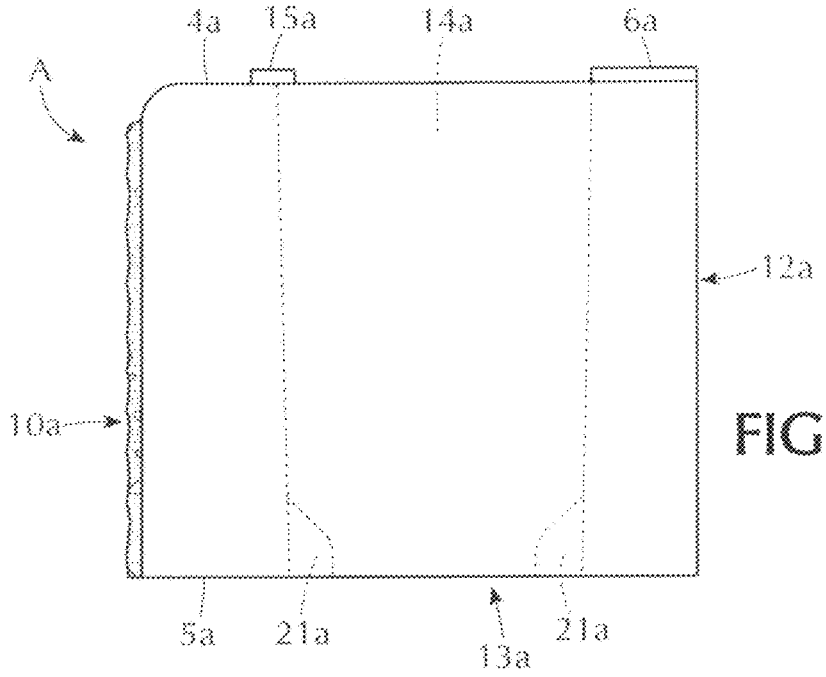
FIG. 5 is a right side view of the corner block A.

The interconnected front, side and rear sections define a center through-cavity (internal cavity) 14*a* that extends completely through the corner block A from a top face 4*a* of the block to a bottom face 5*a*. The cavity 14*a* has a slight inward taper, generally on the order of 1°-1½°, in the top-bottom direction, as best seen in FIGS. 3-5, so that the cavity opening 14*a*' at the top of the corner block A is larger than the cavity opening 14*a*" at the bottom of the block. This taper facilitates removal of the blocks from the mold during manufacture. The internal through-cavity 14*a* is provided to greatly reduce the block weight and thus facilitate transportation, handling and installation of the corner blocks as well as reduce the quantity of concrete and other constituent materials thereby lowering the cost of manufacture of the blocks.

As described later, in use the corner blocks A and B are stacked alternately one atop another to form the corner of a retaining wall or other wall structure. When alternately stacked in this manner, each two adjacent corner blocks A and B interlock with one another with the upper block set back or offset a prescribed setback distance relative to the lower block. This set back occurs in two orthogonal directions so that the corner formed by the stacked alternating corner blocks A and B has two sloped sides and can be used to interconnect at 90 degrees two sloped walls formed of segmental wall blocks that are set back from course to course.

The locking system for locking adjacent upper and lower corner blocks A and B comprises locking members in the form of protrusions or protruding portions provided on the corner blocks. Each corner block has upper protrusions on the top face thereof and lower protrusions on the inside of the internal cavity thereof at the base of the block. When a corner block B is properly positioned atop a corner block A, the upper protrusions of the block A engage with the lower protrusions of the block B and with preselected surface portions of the block B to interlock the two stacked blocks. When a corner block A is properly positioned atop a corner block B, the upper protrusions of the block B engage with the lower protrusions of the block A and with preselected surface portions of the block A to interlock the two stacked blocks. A wall corner of desired height is erected by alternately stacking the corner blocks A and B upon one another in interlocking fashion.

As used herein, the term "protrusion", unless otherwise qualified, is used in its broadest sense to refer to a protruding part, without limitation as to any particular configuration, including a lug, projection, knob, tab and protuberance.

Figure 2:
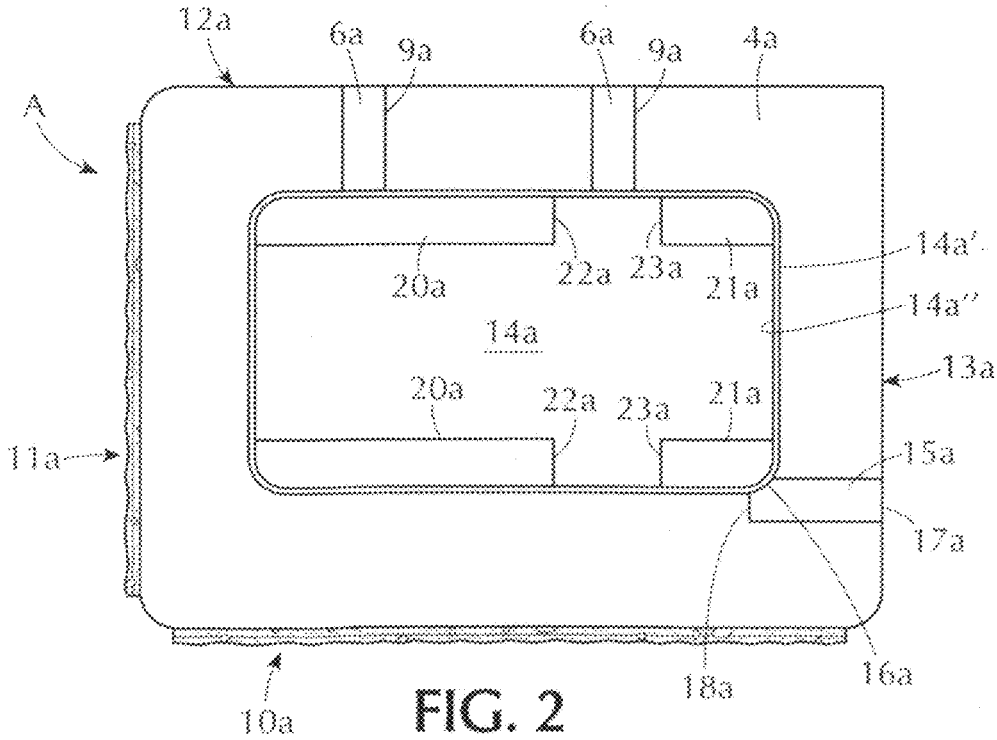
FIG. 2 is a top plan view of the corner block A shown in FIG. 1.

With reference to the corner block A, the locking system comprises two upper protrusions or protruding portions 6*a* provided on the top face 4*a* of the rear section 12*a* rearwardly of the cavity 14*a*. In this exemplary embodiment, the protrusions 6*a* are generally rectangular in shape and each have an outer end face 7*a* that is flush with the outer face of the rear section 12*a*, an inner end face 8*a* that is flush with the inner face of the rear section 12*a*, and two opposed side faces or edges 9*a* that extend between the end faces 7*a*,8*a*. Another upper protrusion or protruding portion 15*a* is provided on the top face 4*a* in the region where the right side section 13*a* joins the front section 10*a*. In this exemplary embodiment, the protrusion 15*a* is generally rectangular in shape and extends lengthwise along the top face 4*a* of the front section 10*a* from the right side section 13*a* to a preselected point beyond the corner of the internal cavity 14*a*. As shown in FIGS. 1-2, the protrusion 15*a* has an inwardly curved corner 16*a* that extends around the corner of the cavity opening 14*a*' at the top of the corner block A. The protrusion 15*a* has one end 17*a* that is flush with the outer face of the right side section 11*a* and an opposite end 18*a* that terminates alongside the corner of the internal cavity 14*a*.

The locking system further includes lower protrusions or protruding portions 20*a*,21*a* at the base or bottom part of the corner block A. As illustrated in FIGS. 2-5, the protrusions 20*a*,21*a* extend along the front and rear walls of the internal cavity 14*a* defined by the opposed inner faces of the front section 10*a* and the rear section 12*a*. In this exemplary embodiment, the protrusions 20*a*,21*a* project inwardly from the cavity wall and slope downwardly for a distance and then extend generally vertically to the bottom of the block. Each protrusion 20*a* has an end face 22*a* that is spaced from and opposed to an end face 23*a* of an adjacent protrusion 21*a*. The bottom of the corner block A is preferably flat so as not to obstruct stacking of the corner blocks one atop another and laying of segmental wall blocks adjacent to the corner blocks during installation of the wall.

Figure 6:
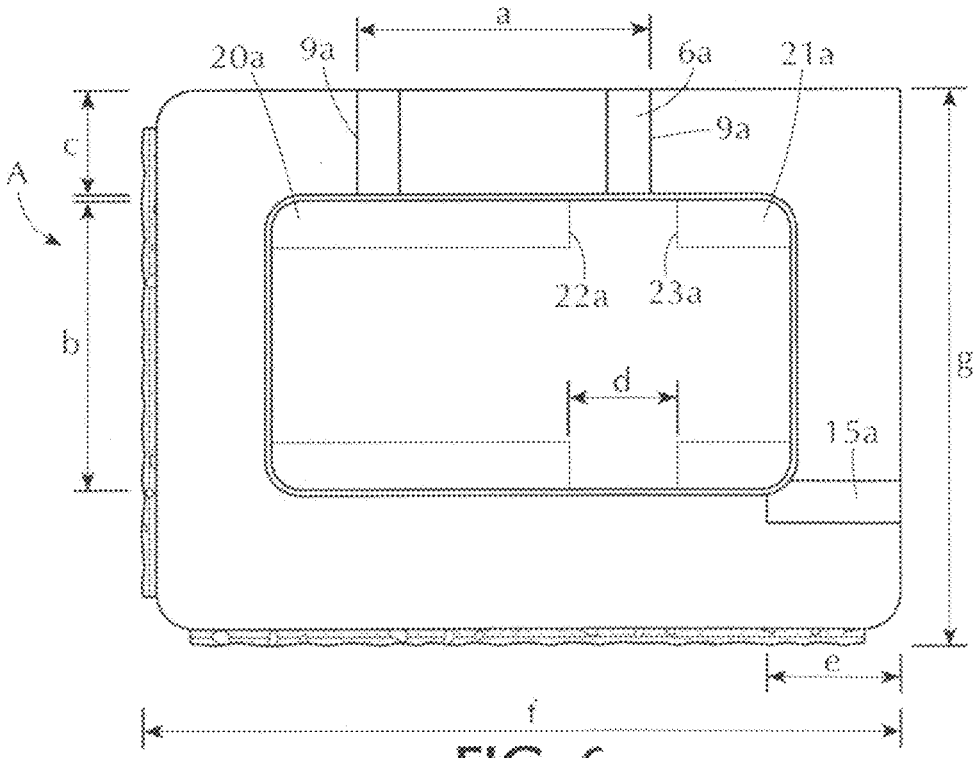
FIG. 6 is a top plan view of the corner block A similar to FIG. 2 and identifying various dimensions referenced in the disclosure.
Figure 7:
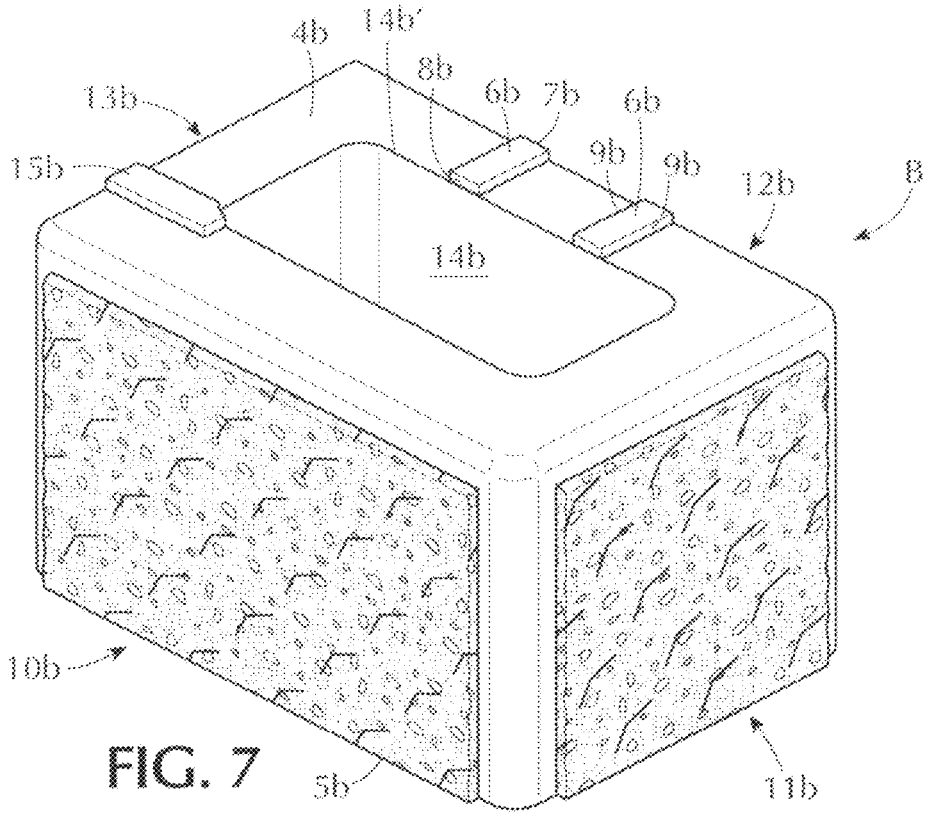
FIG. 7 is a top, front and right perspective view of a corner block B of one embodiment of the disclosure.
Figure 8:
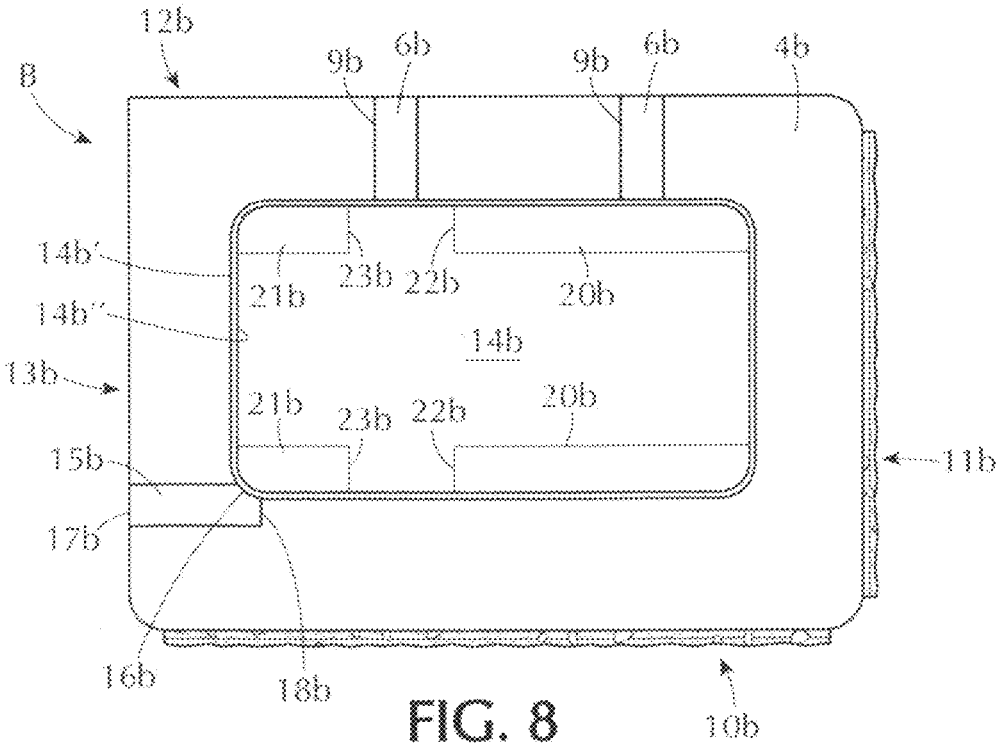
FIG. 8 is a top plan of the corner block B shown in FIG. 7.
Figure 9:
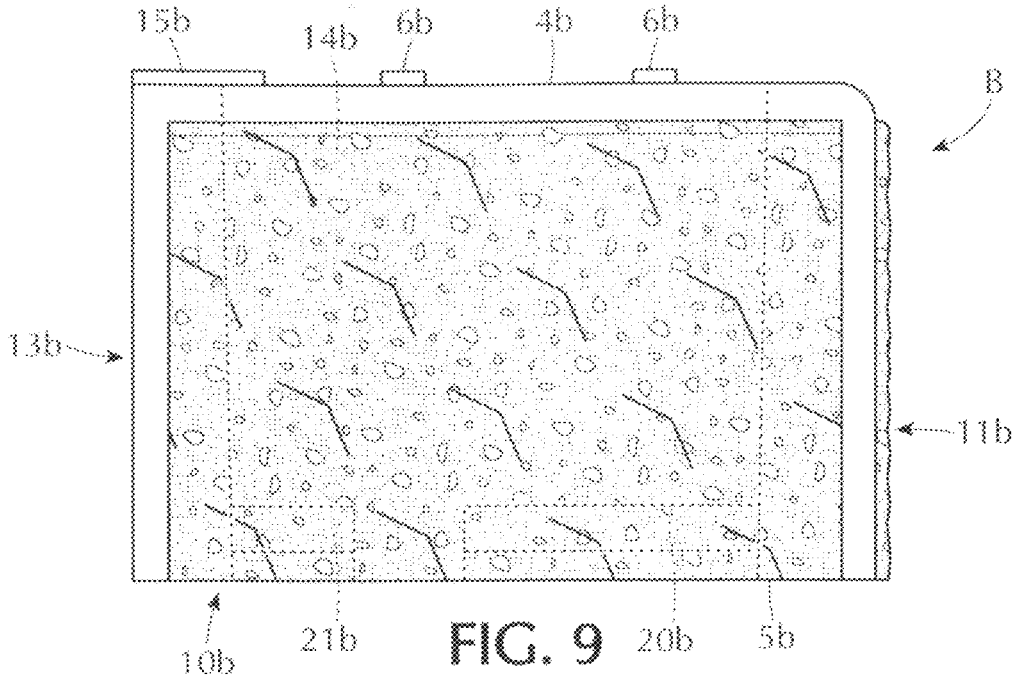
FIG. 9 is a front view of the corner block B.
Figure 10:
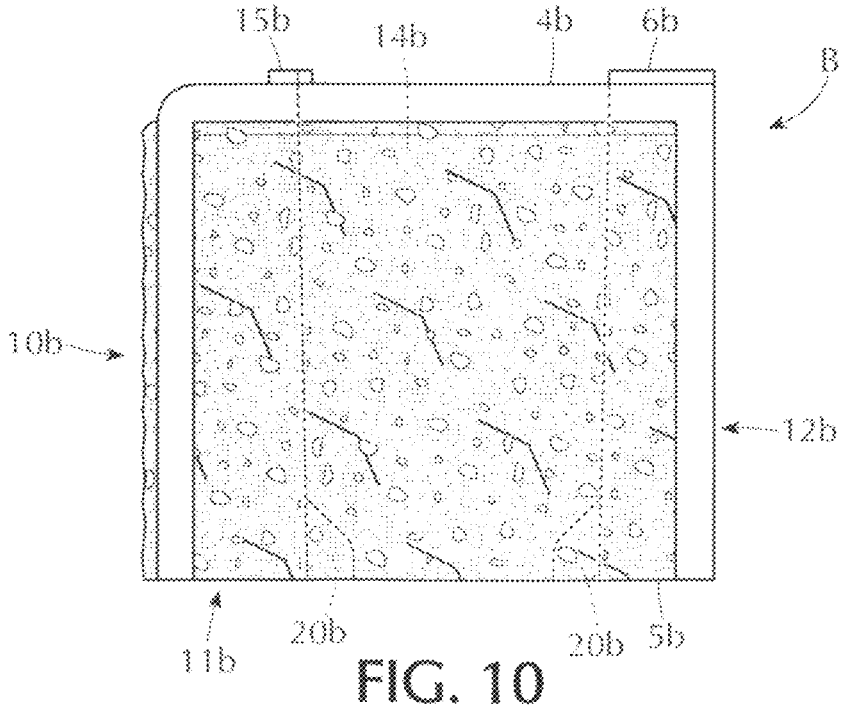
FIG. 10 is a right side view of the corner block B.
Figure 11:
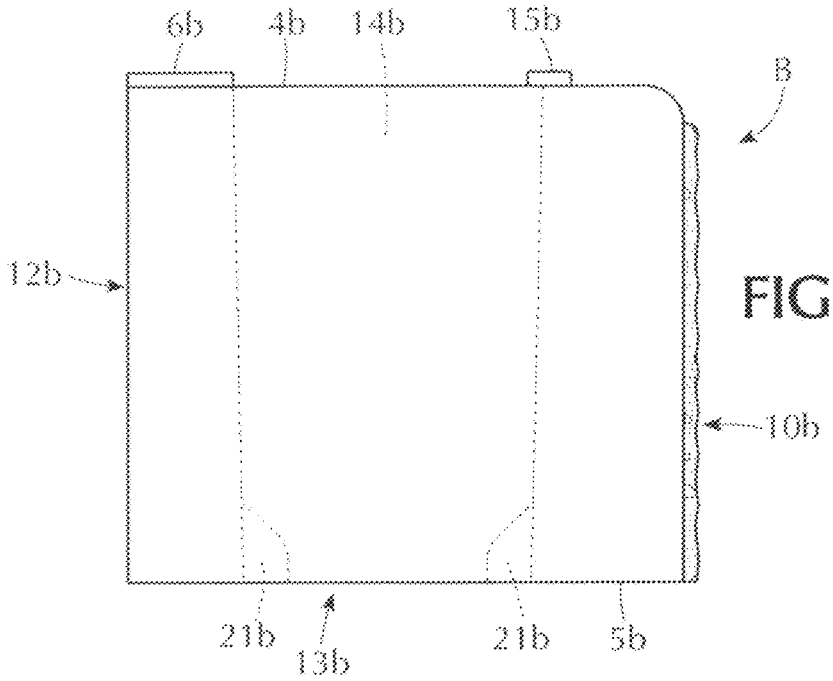
FIG. 11 is a left side view of the corner block B.
Figure 12:
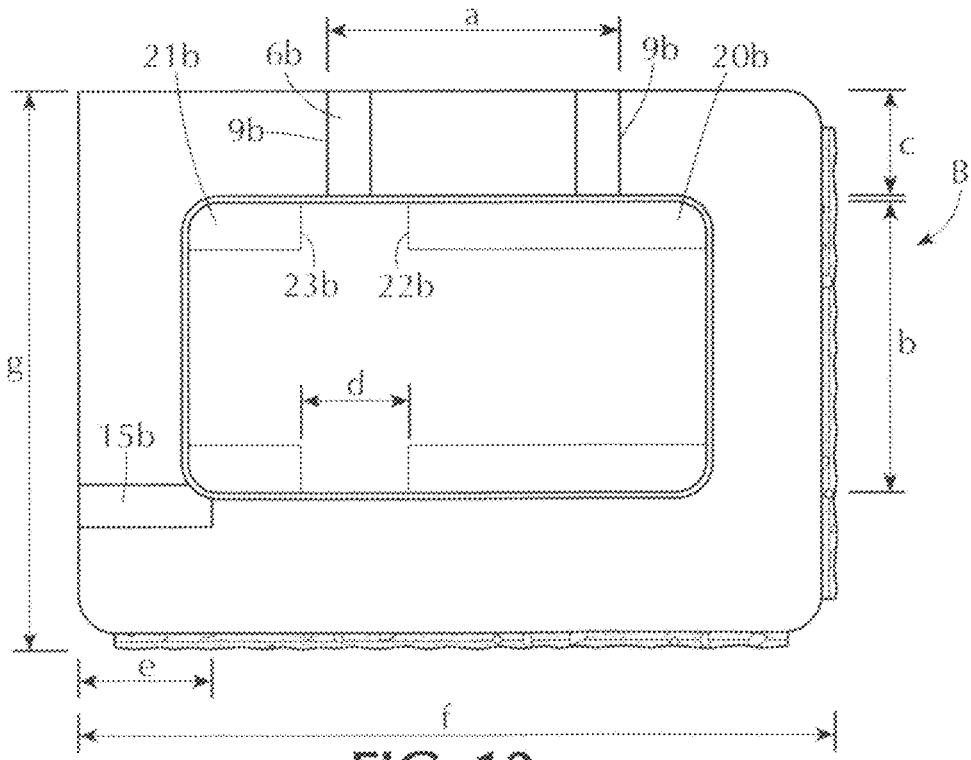
FIG. 12 is a top plan view of the corner block B similar to FIG. 8 and identifying various dimensions referenced in the disclosure.

FIG. 6 is a top plan view similar to FIG. 2 and showing the relative dimensions of portions of the corner block A that contribute to the locking function. Dimension a is the distance between the outer or outside edges 9*a* of the two protrusions 6*a* and is substantially equal to dimension b which is the width of the cavity opening 14*a*" at the bottom of the block. Dimension c is the length of the protrusions 6*a* and substantially equals dimension d which is the spacing or distance between the end opposed end faces 22*a*,23*a* of the protrusions 20*a*,21*a*. Dimension e is the length of the protrusion 15*a* which is substantially equal to dimension f which is the length of the block minus dimension g which is the width of the block minus the dimension of the setback of corner block A relative to an underlying corner block B. The manner in which these dimensional relationships contribute to the locking function of corner blocks A and B will be described later with reference to FIGS. 13-15.

FIGS. 7-12 illustrate corner block B and are mirror images of FIGS. 1-6 which illustrate corner block A. Corner blocks A and B are constructed as mirror images or opposite hands of each other and otherwise have the same construction. Thus corner block A can be considered a left-hand block and corner B a right-hand block, or vice versa. The reference numerals in FIGS. 7-12 are the same as those in FIGS. 1-6 and have the suffix "b" to denote corner block B. The description of corner block A applies equally to corner block B and a detailed description of corner block B is therefore omitted.

In corner block A, the front section 10*a* and the left side section 11*a* have textured outer or front surfaces and in corner block B, the front section 10*b* and the right side section 11*b* have textured outer or front surfaces. The textured surfaces terminate at the top and at opposite sides in curved edges, and the bottoms of the textured surfaces are flat and coplanar with the bottom face of the blocks. All of the curved edges are rounded and have the same size, shape and curvature that create an aesthetically pleasing appearance.

The corner blocks A and B can be used in conjunction with any compatible segmental wall block, such as the segmental retaining wall blocks disclosed, for example, in application Ser. No. 11/900,434 which is incorporated by reference herein in its entirety, which are designed to minimize the likelihood of vertically aligned joints in adjacent courses of blocks and which have successive courses of blocks set back or offset from one another. Similarly, by alternating between corner block A and corner block B in successive courses, there would be no vertically aligned joints at the corner of the wall, and successive corner blocks would be offset from one another in the same manner and to the same degree as the successive courses of blocks in the remainder of the wall.

By way of example, and to facilitate understanding of the disclosure, the following exemplary dimensions are given for the corner blocks A and B. The invention is not, of course, limited or restricted to these dimensions, which are provided solely for illustrative purposes. To manufacture corner blocks of different sizes, these dimensions may be scaled up or down, or other dimensions could be used, as would be well understood by persons ordinarily skilled in the art. In the case of the exemplary embodiment illustrated in FIGS. 1-12, the length dimension f is 12", the width dimension g is 9" and the height dimension is 8". The distance dimension a between the outer edges 9 of the protrusions 6 is 4⅝", which is equal to the width dimension b of the internal cavity opening 14" at the bottom of the block. The length dimension c of the protrusions 6 is 1¾" and is equal to the distance or spacing d between the protrusions 20 and 21. The length dimension of the protrusions 17 is 2¼". The taper of the internal cavity 14 is ⅛". The protrusions 6 and 15 have a width dimension of ¾ and a height of ¼". All of these dimensions have a nominal tolerance of ±1/16", which is standard in the art of molded concrete blocks.

Figure 13:
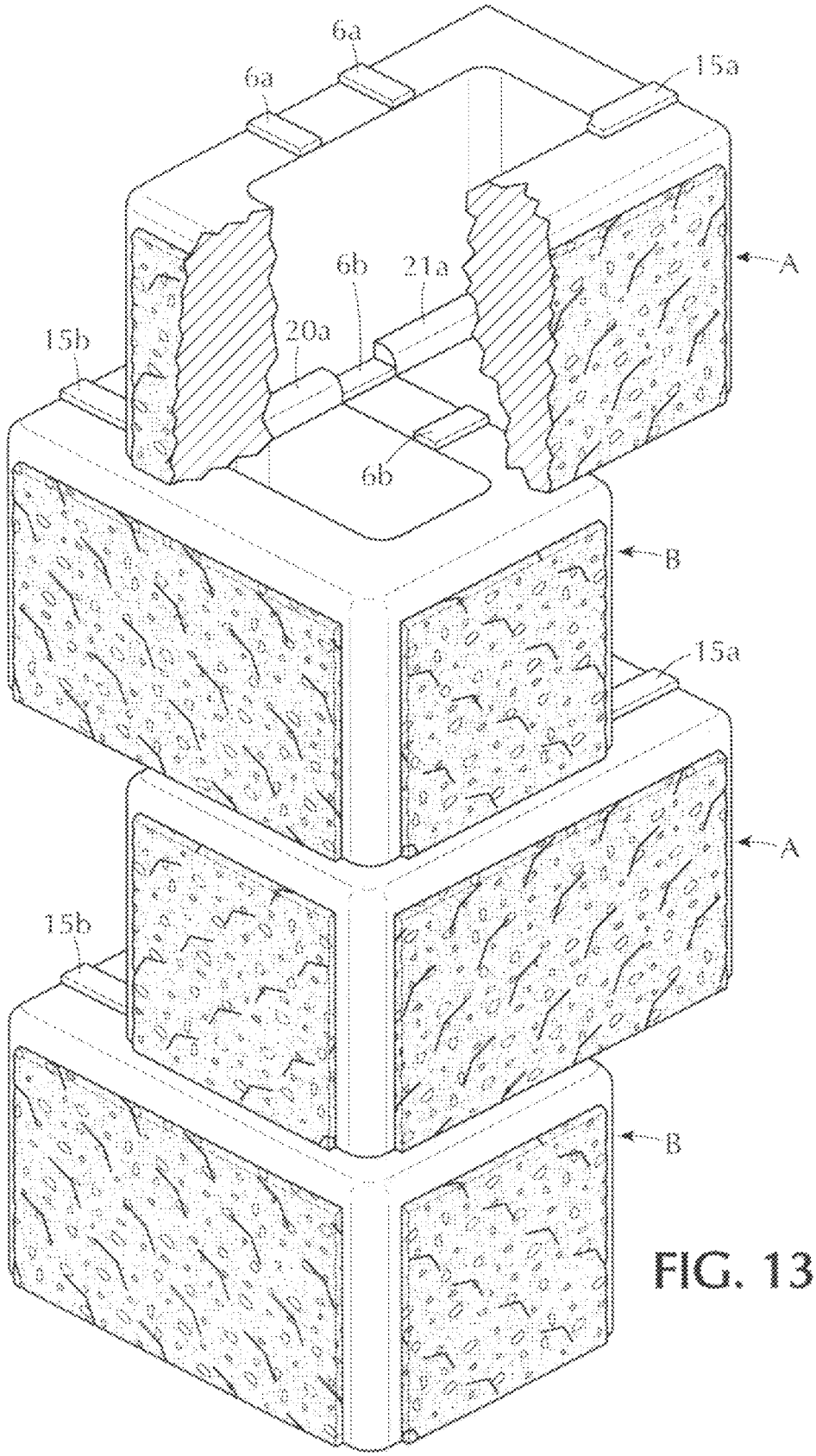
FIG. 13 is a perspective view illustrating two corner blocks A and two corner blocks B alternately stacked upon one another in interlocked relation with a portion of the upper corner block A removed to show the locking systems.
Figure 14:
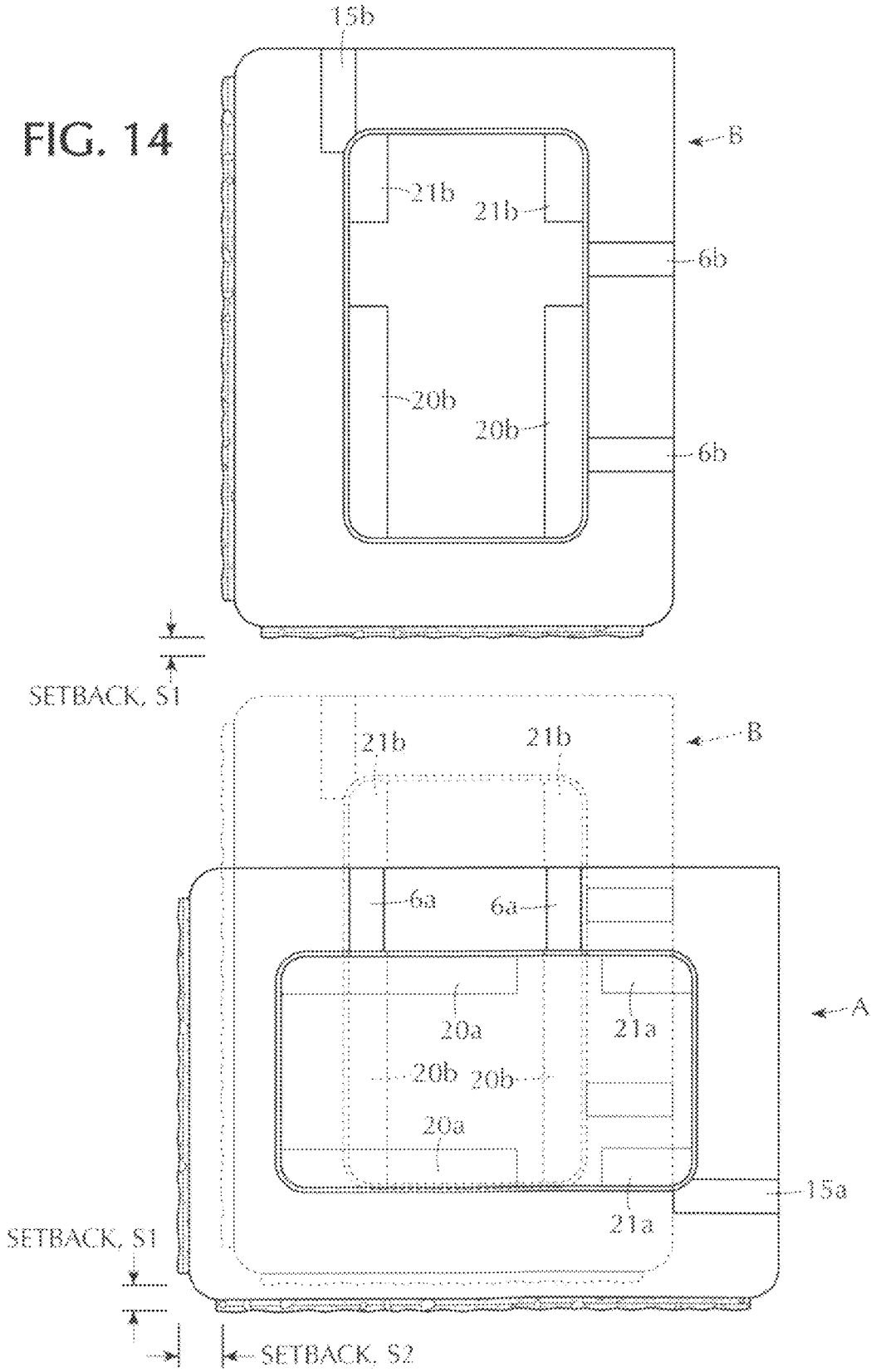
FIG. 14 is an explanatory top view illustrating a corner block B properly orientated for installation atop a corner block A.
Figure 15:
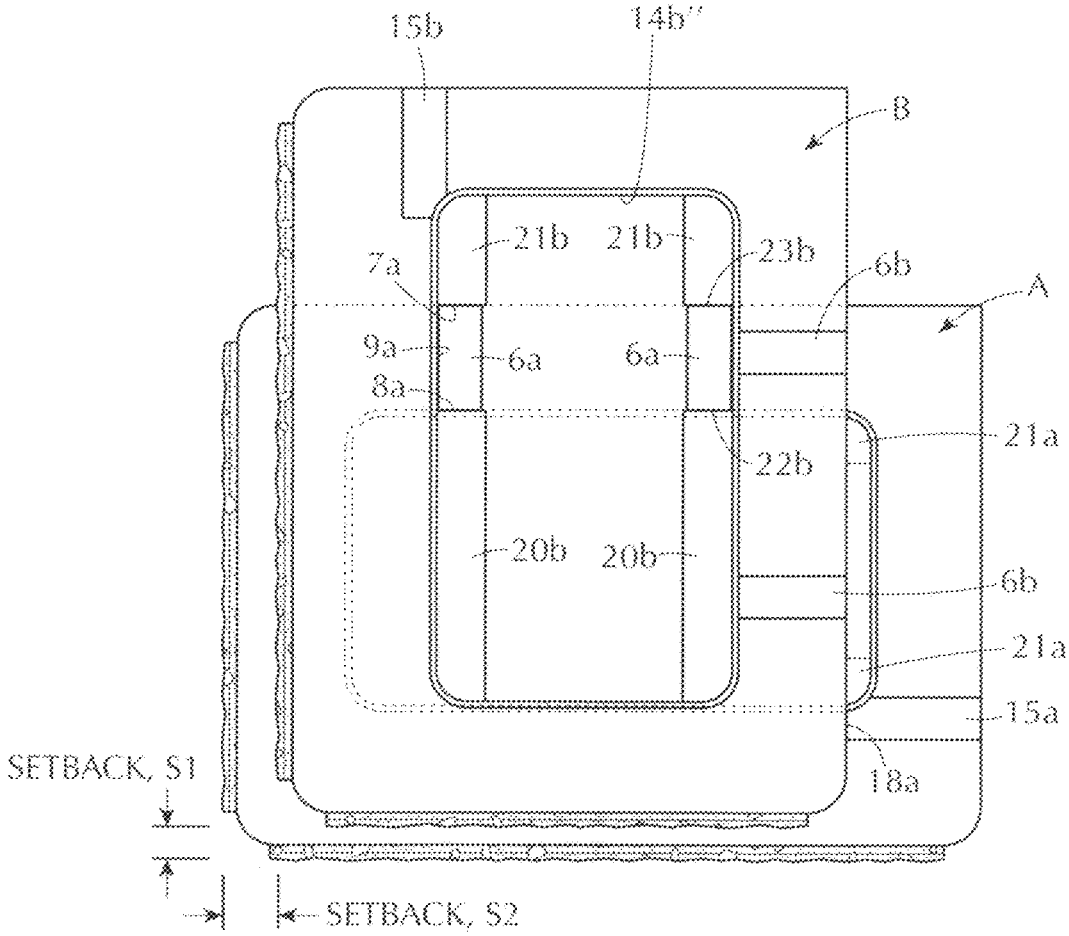
FIG. 15 is an explanatory top view illustrating the corner block B of FIG. 14 firmly positioned and locked in place atop the corner block A.

The method of stacking alternating corner blocks A and B to construct a 90-degree corner will next be described with reference to FIGS. 13-15. FIG. 14 illustrates the orientation of corner blocks A and B prior to stacking the block B atop the block A, and FIG. 15 illustrates the block B stacked on the block A with the two blocks interlocked together as they would appear in a 90-degree corner. Corner block A is laid first and is positioned so that its textured front surface lies along one run of the wall and its textured side surface lies along the other run of the wall. Corner block B is orientated so that its textured front surface is parallel to the textured side surface of block A and its textured side surface is parallel to the textured front surface of block A. While in this orientation, corner block B is positioned atop corner block A as illustrated in broken lines in FIG. 14. Corner block B is then lowered onto corner block A, as illustrated in FIG. 15, so that (1) the bottom wall portion of the internal cavity 14*b* of block B straddles and engages with the outside edges 9*a* of the protrusions 6*a* of block A, (2) the protrusions 6*a* of block A fit into the spaces or gaps between the spaced-apart protrusions 20*b*,21*b* of block B and engage with the opposed end faces 22*b*,23*b* of the protrusions, and (3) the end face 18*a* of the protrusion 15*a* of block A engages with the outer rear face of block B. These different points of engagement between corner blocks A and B effectively interlock the blocks and prevent shifting of one block relative to the other.

This locking system is obtained by setting the dimension a between the outside edges 9*a* of the two protrusions 6*a* equal to the width dimension d of the cavity opening 14*b*" at the bottom of block B, setting the length dimension c of the protrusion 6*a* of block A equal to the gap dimension d between the opposed end faces 22*b*,23*b* of the protrusions 20*b*,21*b* of block B and setting the length dimension e of the protrusion 15*a* of block A equal to the length dimension f minus the width dimension g of block B minus the setback S2 of block B relative to block A.

Provision of the protrusion 15*a* stabilizes the locking together of the corner blocks A and B and prevents shifting of the blocks in case there is slight play between one or both of the protrusions 6*a* and the protrusions 20*b*,21*b* or between the outside edges of the protrusions 6*a* and the bottom wall portion of the internal cavity 14*b*. Thus the protrusion 15*a* could be omitted though its inclusion is preferable. As another alternative, instead of the two protrusions 6*a*,6*a*, a single protrusion that extends the length of dimension a could be used. The single protrusion would function like the two protrusions 6*a*,6*a* and has two opposite outside edges that engage with the opposed end faces 22*b*,23*b* of the protrusions 20*b*, 21*b*. The height of the protrusions 20*b*,21*b* is not critical though it is preferable that the protrusions have a height greater than that of the protrusions 6*a*.

As illustrated in FIG. 15, when the corner block B is fitted atop and interlocked with the corner block A, the block B is set back in two directions from the block A. The side textured face of block B is set back from the front textured face of block A by a setback S1, and the front textured face of block B is set back from the side textured face of block A by a setback S2. Thus the corner block B will be installed with fixed setbacks S1 and S2 that define the slope of the installed segmental retaining wall or other wall structure. The textured front and side faces of the corner blocks A and B constitute the two exterior or exposed sides of the assembled corner.

Though the locking system has been described with respect to stacking a corner block B on a corner block A, the same locking system applies when stacking a corner block A on a corner block B. This is illustrated in FIG. 13 which shows a corner structure comprised of alternating corner blocks A and B with a portion of the upper corner block A removed to show the locking system.

The method of manufacturing the corner blocks A and B will next be described with reference to FIGS. 16-17. Generally, the process is initiated by mixing dry cast masonry concrete that will form the corner blocks. Dry cast, low slump masonry concrete is well known in the art of retaining wall blocks. The concrete will be chosen so as to satisfy predetermined strength, water absorption, density, shrinkage, and related criteria for the block so that the corner block will perform adequately for its intended use. If desired, color can be added to the concrete mix by way of pigmentation or by the addition of colored aggregate as is well known in the art of casting concrete blocks. A person having ordinary skill in the art would be able to readily select a material constituency that satisfies the desired block criteria. Further, the procedures and equipment for mixing the constituents of the dry cast masonry concrete are well known in the art.

Once the concrete is mixed, it is transported to a hopper, which holds the concrete near a mold (not shown). In this exemplary embodiment, the mold is constructed to permit the formation of a block unit 30, as shown in FIGS. 16-17, which in this exemplary embodiment is a four-block unit from which two diagonal corner blocks A and two opposing diagonal corner blocks B are produced in one manufacturing cycle. The corner block A is a mirror image or opposite hand of the corner block B. The mold is selected so that the four corner blocks A and B are formed in face-to-face contact by a single casting process. For this purpose, the mold is provided with mold parts (e.g., mold cavities) that conform in shape to the corresponding parts of the corner blocks A, B including the protrusions and through-cavities as described above. For example, the walls of the mold should measure the height and depth of the resulting blocks, and should be made of a thickness which will accommodate the processing parameters of block formation given a specific mold composition.

When forming the block unit 30, a flat production pallet (not shown) made of steel, plastic, or wood, for example, is positioned beneath the mold. After positioning the pallet beneath the mold, an appropriate amount of concrete mixture from the hopper is loaded, via one or more feed drawers, into the mold assembly (e.g., via the mold cavities). The process and equipment for transporting the concrete mixture and loading it into the mold are well known in the art.

The concrete mixture in the mold must next be compacted or consolidated to densify it. This is accomplished primarily through vibration of the concrete mixture, in combination with the application of pressure exerted on the concrete mixture from above. The vibration can be exerted by vibration of the pallet underlying the mold (table vibration), or by vibration of the mold (mold vibration), or by a combination of both actions. As is well known in the art, the pressure is exerted by a compression head that carries one or more stripper shoes that contact the concrete mixture from above. The timing and sequencing of the vibration and compression is variable, and depends upon the characteristics of the concrete mixture and the desired results. The selection and application of the appropriate sequencing, timing, and types of vibrational forces, are within the ordinary skill in the art. Generally, these forces contribute to fully filling the mold (e.g., the forming cavities), so that there are not undesired voids in the finished block, and to densifying the concrete mixture so that the resulting finished corner blocks A, B will have the desired weight, density, and performance characteristics.

After densification, the pre-cured block unit 30 is discharged from the mold. Preferably, discharge occurs by lowering the pallet relative to the mold, while further lowering the stripper shoe through the mold cavity to assist in stripping the pre-cured block unit 30 from the mold. The stripper shoe is then raised upwardly out of the mold and the mold is ready to repeat this production cycle.

Figure 16:
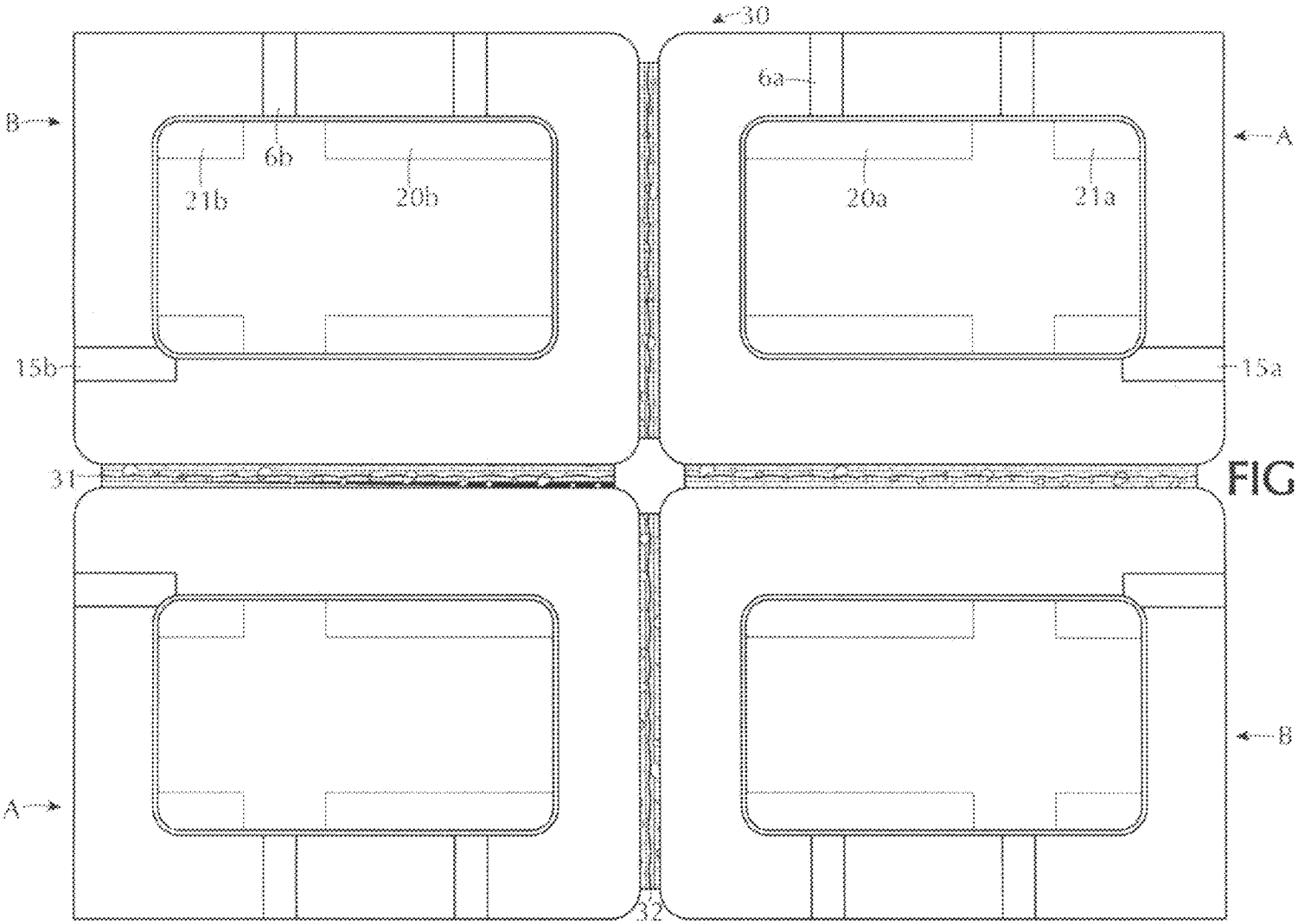
FIG. 16 is a plan view illustrating a molded four-block unit of two diagonal corner blocks A and two opposing diagonal corner blocks B produced in one manufacturing cycle.
Figure 17:
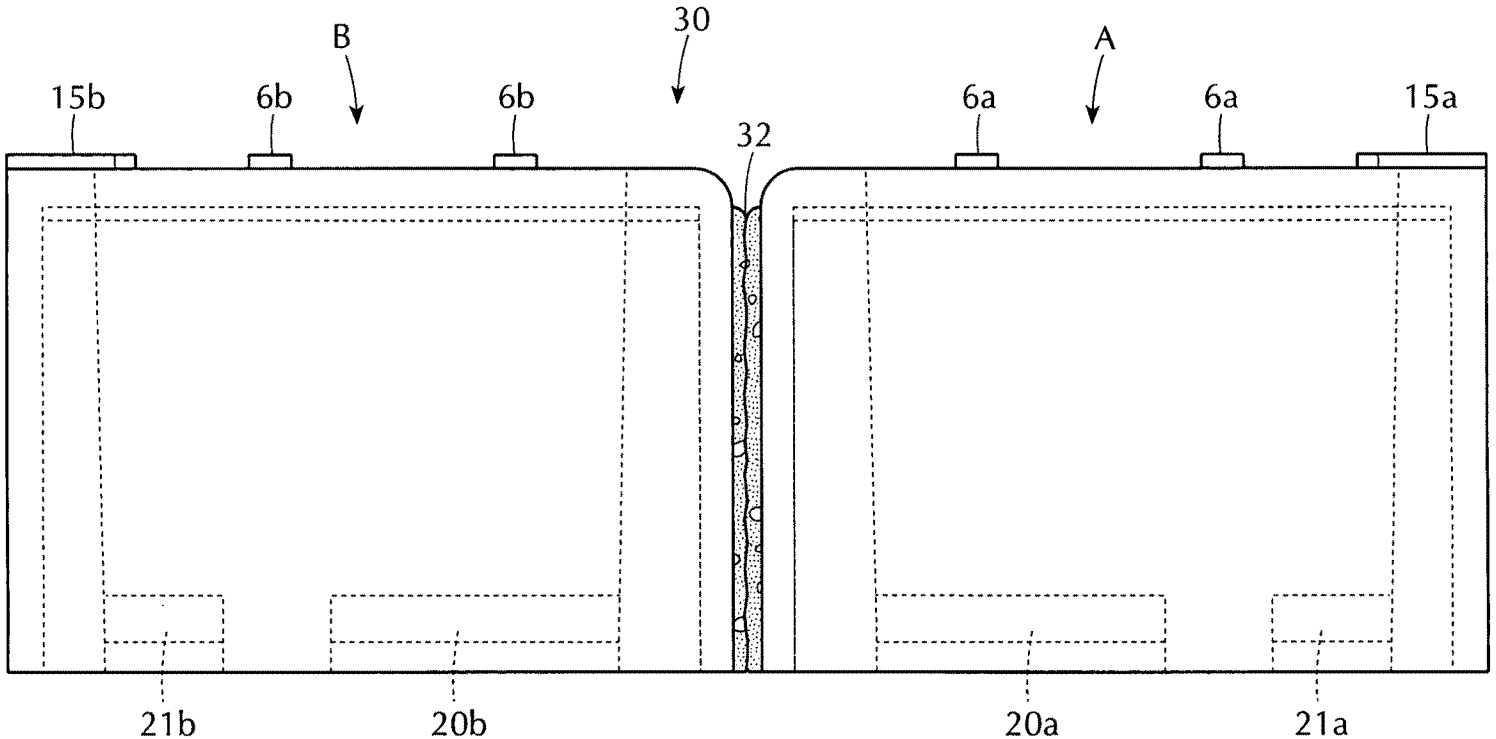
FIG. 17 is a front view of the four-block unit shown in FIG. 16.

FIGS. 16-17 show the state of the pre-cured block unit 30. Once the pre-cured block unit 30 has been removed from the mold, it can be transported away from the mold assembly for subsequent curing. The block unit 30 may be cured through any means known to those of skill in the art. Examples of curing processes that are suitable include air curing, moist curing, autoclaving, and steam curing. Any of these processes for curing the block unit 30 may be implemented by those of skill in the art. Once cured, the block unit 30 is removed from the pallet 130.

After curing, the cured, molded block unit 30 consists of four corner block structures that are joined together at common interfaces along split lines 31 and 32, with each of the corner block structures having the protrusions 6,15 protruding outwardly from the top face thereof and the protrusions 20,21 protruding inwardly from the wall of the cavity 14. The cured, molded block unit 30 is then removed from the pallet and transported to a splitting station where it is split along the split lines 31,32 to separate the block unit 30 into two corner blocks A and two corner blocks B. The split lines 31,32 are formed during molding of the block unit 30 and correspond to the perimeter of the opposed textured front surfaces of the confronting blocks. The splitting process can be performed manually using a chisel and hammer or can be performed using machines known to those skilled in the art for such purposes. After the splitting process, each of the corner blocks A, B is provided with a textured front surface and a textured side surface both of which are exposed and visible when the corner blocks are assembled to form a corner as shown in FIG. 13, for example. Also, after the splitting process, the textured surfaces of the corner blocks A, B are bordered by curved, rounded edges that present an aesthetically pleasing appearance and enhance the attractiveness of a retaining wall or other wall structure having a corner constructed of the corner blocks.

Once split, the corner blocks A, B can be packaged for storage and subsequent shipment to a jobsite, and can then be used in forming a corner structure for a retaining wall or other wall structure.

From the foregoing description, it can be seen that the present invention comprises improved corner blocks, methods of manufacturing the corner blocks, and corner structures formed of the corner blocks. It will be appreciated by those skilled in the art that obvious changes can be made to the embodiments described in the foregoing description without departing from the broad inventive concept thereof. It is understood, therefore, that this disclosure is not limited to the particular embodiments disclosed, but is intended to cover all obvious modifications thereof which are within the scope and the spirit of the disclosure as defined by the appended claims.

What I claim is:

1. A corner block having spaced-apart front and rear sections interconnected by two laterally spaced-apart side sections that jointly define an internal cavity that extends completely through the block from a top face thereof to a bottom face thereof, an upper protrusion protruding upwardly from the top face of the rear section rearward of the cavity, and two lower protrusions protruding from a wall of the cavity into the cavity at a bottom portion of the block, the two lower protrusions being spaced apart to define a gap therebetween, and the upper protrusion being located and dimensioned relative to the two lower protrusions so that two corner blocks that are mirror images of one another can be stacked one atop the other with the upper corner block rotated 90 degrees relative to the lower corner block and the upper protrusion of the lower corner block fitted into the gap between the two lower protrusions of the upper corner block to interlock the upper and lower corner blocks.

2. A corner block according to claim 1;

including two upper protrusions protruding upwardly from the top face rearwardly of the cavity, the two upper protrusions having respective outside edges that are spaced apart a distance substantially equal to the distance between two opposed wall portions of the cavity at the bottom of the corner block, wherein when two corner blocks that are mirror images of one another are stacked one atop the other with the upper corner block rotated 90 degrees relative to the lower corner block, the two opposed wall portions of the cavity of the upper corner block straddle and engage with the outside edges of the two upper protrusions of the lower corner block to interlock the upper and lower corner blocks.

3. A corner block according to claim 2;

including four lower protrusions, two of which protrude from one of the opposed wall portions in spaced-apart relation to define a gap therebetween and two of which protrude from the other of the opposed wall portions in spaced-apart relation to define a gap therebetween at the bottom portion of the block, wherein when two corner blocks that are mirror images of one another are stacked one atop the other with the upper corner block rotated 90 degrees relative to the lower corner block, each of the two upper protrusions of the lower corner block fits into a respective gap between two of the lower protrusions of the upper corner block to interlock the upper and lower corner blocks.

4. A corner block according to claim 1;

including four lower protrusions, two of which protrude from one of two opposed wall portions of the cavity in spaced-apart relation to define a gap therebetween and two of which protrude from the other of the two opposed wall portions of the cavity in spaced-apart relation to define a gap therebetween at the bottom portion of the block, wherein when two corner blocks that are mirror images of one another are stacked one atop the other with the upper corner block rotated 90 degrees relative to the lower corner block, the upper protrusion of the lower corner block fits into the gaps between the lower protrusions of the upper corner block to interlock the upper and lower corner blocks.

5. A corner block according to claim 4;

wherein the upper protrusion has two opposite outside edges that are spaced apart a distance substantially equal to the distance between two opposed wall portions of the cavity at the bottom of the corner block, wherein when two corner blocks that are mirror images of one another are stacked one atop the other with the upper corner block rotated 90 degrees relative to the lower corner block, the two opposed wall portions of the cavity of the upper corner block straddle and engage with the outside edges of the upper protrusion of the lower corner block to interlock the upper and lower corner blocks.

6. A corner block according to claim 1;

including another upper protrusion protruding upwardly from the top face and extending along the top face of the front section and terminating at one end in an end face, wherein when two corner blocks that are mirror images of one another are stacked one atop the other with the upper corner block rotated 90 degrees relative to the lower corner block, the end face of the other upper protrusion of the lower corner block engages with an outer face of the rear section of the upper corner block to assist in interlocking the upper and lower corner blocks.

7. A corner of a wall comprising stacked corner blocks stacked one atop another, each of the corner blocks being constructed according to claim 1.

8. A corner of a wall according to claim 7;

wherein alternately stacked corner blocks are mirror images of each other.

9. A corner of a wall according to claim 7;

wherein each successive corner block is offset from the preceding corner block.

10. A corner of a wall according to claim 7; wherein each successive corner block is offset in two directions from the preceding corner block.

11. A corner block according to claim 1; wherein no portion of the upper protrusion extends below the level of the top face.

12. A corner block according to claim 1; wherein the upper protrusion has a length in the front-to-rear direction of the block that is substantially equal to the gap spacing between the two lower protrusions.

13. A corner block according to claim 1; wherein the upper protrusion is directly connected to the top face of the rear section.

14. A corner block having spaced-apart front and rear sections interconnected by two laterally spaced-apart side sections that jointly define an internal cavity that extends completely through the block from a top face thereof to a bottom face thereof, an upper protrusion connected to and protruding upwardly from the top face of the rear section rearward of the cavity and that fits in a gap between two protrusions provided in the internal cavity of an upper corner block which is rotated 90° relative to the corner block and stacked atop the corner block, and two lower protrusions that protrude from a wall of the cavity into the cavity at a bottom portion of the corner block in spaced-apart relation to define a gap therebetween into which fits the upper protrusion of a lower corner block which is rotated 90° relative to the corner block and stacked beneath the corner block.

15. A corner block according to claim 14;

including two upper protrusions that protrude upwardly from the top face rearwardly of the cavity and that have respective outside edges which are spaced apart a distance substantially equal to the distance between two opposed wall portions of the cavity at the bottom of the corner block so that two opposed wall portions of the cavity of an upper corner block stackable atop the corner block straddle and engage with the outside edges of the two upper protrusions of the corner block.

16. A corner block according to claim 14;

wherein the upper protrusion has two opposite outside edges that are spaced apart a distance substantially equal to the distance between two opposed wall portions of the cavity at the bottom of the corner block so that two opposed wall portions of the cavity of an upper corner block stackable atop the corner block straddle and engage with the outside edges of the upper protrusion of the corner block.

17. A corner block according to claim 14;

including another upper protrusion that protrudes upwardly from the top face and extends along the top face of the front section and terminates at one end in an end face that engages with an outer face of the rear section of an upper corner block stackable atop the corner block.

18. A corner of a wall comprising stacked corner blocks stacked one atop another, each of the corner blocks being constructed according to claim 14.

19. A corner of a wall according to claim 18; wherein alternately stacked corner blocks are mirror images of each other.

20. A corner of a wall according to claim 18; wherein each successive corner block is offset from the preceding corner block.

21. A corner of a wall according to claim 18; wherein each successive corner block is offset in two directions from the preceding corner block.

22. A corner block according to claim 14;

wherein no portion of the upper protrusion extends below the level of the top face.

23. A corner block according to claim 14;

wherein the upper protrusion has a length in the front-to-rear direction of the block that is substantially equal to the gap spacing between the two lower protrusions.

* * * * *